United States Patent [19]

Kemmel et al.

[11] Patent Number: 4,479,077

[45] Date of Patent: Oct. 23, 1984

[54] SEWING MACHINE WITH A UNIVERSAL MOTOR

[75] Inventors: Patrice J. Kemmel, Stutensee; Jürgen Hartwig, Karlsruhe-Durlach, both of Fed. Rep. of Germany

[73] Assignee: Pfaff Haushaltmaschinen GmbH, Fed. Rep. of Germany

[21] Appl. No.: 516,269

[22] Filed: Jul. 22, 1983

[30] Foreign Application Priority Data

Sep. 15, 1982 [DE] Fed. Rep. of Germany ..... 3234171

[51] Int. Cl.[3] ..... H02P 7/36; H02K 23/64

[52] U.S. Cl. ..... 318/245; 318/345 B; 318/345 C; 318/345 CB; 318/345 G

[58] Field of Search ..... 318/345 G, 345 A, 345 AB, 318/345 B, 345 C, 345 CA, 345 CB, 345 D, 345 E, 345 H, 341, 245

[56] References Cited

U.S. PATENT DOCUMENTS 3,447,055 5/1969 Mason ..... 318/345 B X
3,849,710 11/1974 Mason ..... 318/331
3,952,241 4/1976 Takemura et al. ..... 323/326

FOREIGN PATENT DOCUMENTS 56-94993 7/1981 Japan ..... 318/345 C

*Primary Examiner*—J. V. Truhe
*Assistant Examiner*—Bentsu Ro
*Attorney, Agent, or Firm*—McGlew and Tuttle

[57] ABSTRACT

In a sewing machine with a universal motor, a speed control for the motor, a lamp, and a plug connection on the sewing machine housing for connecting the power supply and speed control lines to the motor and to the lamp, for equivalent replacement of the normal impedance starter by one with integrated phase angle control, a phase angle control is provided as a speed controller which comprises a rectifier bridge consisting of diodes for current supply to the phase angle control and to the lamp, as well as a rectifier bridge with semiconductor devices controlled by the phase angle control, for the control of the motor. To leave the known three-terminal plug connection on the sewing machine housing for the connection both of the power supply and for the phase angle control, the power supply leads are connected at both rectifier bridges, the negative terminals of which are connected to the common terminal of the motor and lamp, which the positive terminal of the phase angle-controlled rectifier bridge is connected to the second terminal of the motor. The positive terminal of the diode rectifier bridge is connected to the second terminal of the lamp.

8 Claims, 1 Drawing Figure

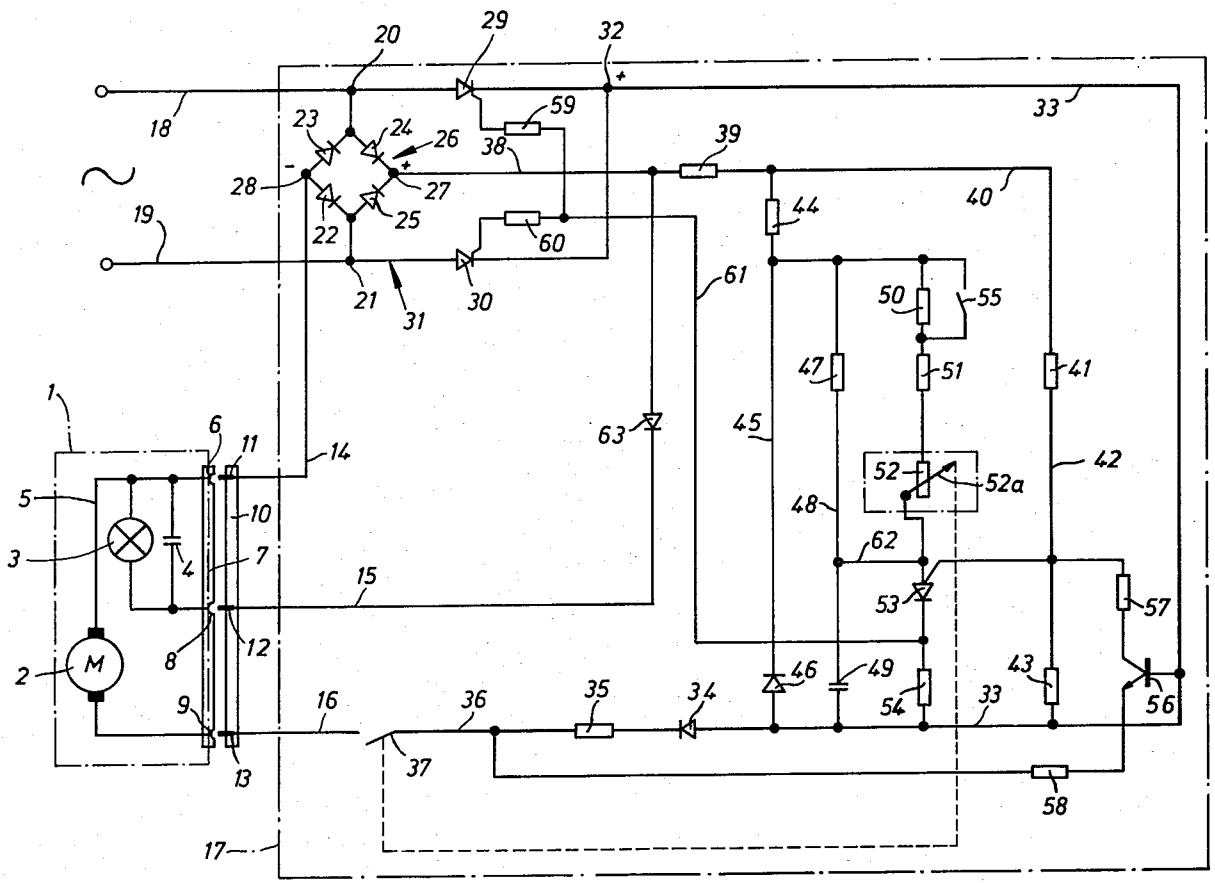
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
52a
53
54
55
56
57
58
59
60
61
62
63
M

SEWING MACHINE WITH A UNIVERSAL MOTOR

FIELD AND BACKGROUND OF THE INVENTION

The present invention relates in general to sewing machines and in particular to a new and useful arrangement which utilizes a diode rectifier bridge and a phase controlled rectifier bridge for controlling the speed of a sewing machine motor as well as powering a lamp of the sewing machine which are connected by a three plug connector in the housing of the sewing machine.

For the control of their motor, such sewing machines are generally equipped with a foot starter that contains a resistor. There are also sewing machines which have installed in their housing an electronic phase angle control. The phase angle control is itself controllable through a potentiometer arranged in the respective foot starter. A starter with an ohmic resistor or a starter with built-in phase angle control for controlling the rpm of the sewing machine can thus be selectively connected to the sewing machine only at considerable expense, especially since the usual phase angle control operating with alternating current substantially reduces the maximum attainable speed of the sewing machine.

Replacing a normal impedance starter by one with built-in phase angle control was not successful in particular because using a phase angle control would have required greater expense for line connections to the sewing machine if there was to be no loss of speed as compared with the impedance starter. The task involved in the present invention is therefore, to provide an electronic starter control with which the maximum rpm of the motor which is controllable with the normal impedance starter, can also be reached and where the connection to the sewing machine is feasible without the increased cost of circuitry.

SUMMARY OF THE INVENTION

Accordingly, an object of the present invention is to provide a sewing machine with a housing, connected universal motor acting as a drive motor, a speed control for varying motor speed, a lamp and a plug connection in the sewing machine housing for connecting power lines and a speed control to the motor and lamp, wherein the speed control is a phase angle control which comprises a first rectifier bridge made up of four diodes for current supply to the phase angle control and to the lamp as well as a second rectifier including portions of the diode bridge as well as additional semiconductor devices controlled by the phase angle control for controlling the motor.

When replacing the impedance starter by a phase angle control, it is now possible not only to improve the piercing force of the needle at low speeds of rotation, but also to reach the previously controllable maximum sewing speed despite the phase angle losses.

A great many of the known household sewing machines are equipped only with a three-terminal plug for connection to the power supply cable to supply the motor installed in the sewing machine and the lamp as well as to connect the rpm control with the motor. One plug terminal serves for the joint connection of one lead of the motor and of one lead of the lamp to one power supply lead. The other lead of the lamp is connected via the second plug terminal to the other power supply lead and to one of the two lines of the rpm control. Lastly, the other lead of the motor is connected via the third plug terminal to the second line of the rpm control.

With these sewing machines equipped with a three-terminal plug connection (West German Utility Model No. 17 13 417, FIG. 12) it has hitherto not been possible to use an external speed regulator operating with phase angle control instead of a normal one designed as an impedance starter. To do so it is necessary either to change the plug device or to integrate the phase angle control in the housing of the sewing machine, which would greatly add to the cost of the sewing machine and would rule out retrofitting of existing sewing machines. For a conventional A.C. phase angle control it is impossible to use the same electric line for both the motor and the lamp with the circuit arrangements as now provided, because in that case the lighting current would be controlled as well.

It is, therefore, the further object of the invention to design the circuit for the phase angle control in such a way that the three-terminal plug connection at the sewing machine housing and its wiring to the motor and the lamp can be left as is.

Another object of the invention is to provide such a sewing machine arrangement wherein the plug connecting the universal motor with lamp to the power supply and speed control is a three-terminal plug with one lead of the motor and one lead of the lamp that are joined together being connected to one terminal which is connected to one of the power supply lines, the other lead of the lamp being connected over the second terminal to the other power supply line and one line of the speed control, and another lead of the motor being connected over the third terminal of the plug to a second line of the speed control. The power supply line is connected at both rectifier bridges, a negative terminal being connected to a joint terminal of the motor and lamp while a positive terminal of the second rectifier bridge is connected to the second terminal of the motor and a positive terminal of the first rectifier bridge is connected to the second terminal of the lamp. It is thereby possible to use both a speed control with conventional impedance starter and a speed regulation with full wave phase angle control disposed therein with torque boost without adversely affecting the illumination of the sewing machine and without any change in the three-terminal plug connection.

Another object of the invention is to provide a sewing machine wherein a diode is arranged in the connection between the positive terminal of the first rectifier bridge and the second terminal of the lamp. This prevents a reaction of the anti-interference capacitor for the motor and impedance starter which is connected in parallel with the lamp, on the phase angle control of the motor, upon failure of the lamp.

An inexpensive design of the circuit is obtained by saving one half of the phase controlled rectifier bridge. This is possible according to another object of the invention wherein the second phase angle controlled rectifier bridge comprises, in addition to two diodes of the first rectifier bridge, two thyristors.

A further object of the invention is to provide a sewing machine arrangement which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only drawing in the application is a schematic circuit diagram of the inventive circuit arrangement.

DESCRIPTION OF THE PREFERRED EMBODIMENT

The diagram shows, in a sewing machine housing 1, which is indicated only schematically, a motor 2 as well as a lamp 3 and a capacitor 4 connected in parallel with the lamp. The motor 2, lamp 3 and capacitor 4 are connected by a line 5 which ends in a jack or connector 6 of a plug housing 7. The plug housing 7 is integrated in the sewing machine housing 1. It has two additional jacks or connectors 8 and 9, of which 8 is connected with the lamp 3 and with the capacitor 4, while jack 9 is connected with the motor 2. To be coupled to the plug housing 7 is a plug connection 10 with plugs or connectors 11, 12 and 13. The latter are connected to lines, 14,15 and 16, which lead into an indicated housing 17 of a control device for changing the speed of the motor.

The control device is connectable to the A.C. power supply by two leads 18 and 19. The two power supply leads 18 and 19 are connected to terminals 20 and 21 of a bridge rectifier 26 equipped with diodes 22, 23, 24 and 25. The rectifier has one terminal 27 with positive potential and one terminal 28 with negative potential. Terminal 28 is connected to line 14. At the terminal 20 a thyristor 29 is connected, and at terminal 21 a thyristor 30. The two thyristors 29 and 30 together with the two diodes 22 and 23 form a phase-controlled rectifier bridge 31 having a terminal 32 with positive and the terminal 28 with negative potential. By its terminal 32 the rectifier bridge 31 is connected via a line 33, a diode 34, a resistor 35, a line 36 and a switch 37, to the line 16 which is connected at plug 13.

Terminal 27 is connected via a line 38 to a resistor 39, a line 40, a resistor 41, a line 42 and a resistor 43 to the line 33. Line 40 is connected through a resistor 44, a line 45, and a zener diode 46 to line 33. Line 45 is connected via a resistor 47, a line 48 and a capacitor 49 to the line 33.

Lastly, there is connected to line 45 a resistor 50 which is coupled with line 33 via an additional resistor 51, a potentiometer 52, a PUT (Programmable Universal Transistor) 53 and a resistor 54. The potentiometer 52 comprises a wiper **52*a*, which is connected to the switch 37 and turns it off in the position of maximum resistance. A switch 55 is connected in parallel with resistor 50. Connected to line 33 is the base of a transistor 56, the collector of which is connected via a resistor 57 to line 42, and the emitter of which is connected via a resistor 58 to line 36**.

The thyristors or semiconductor devices 29 and 30 are connected by their firing or control terminals, via a resistor 59 and 60 for each, to a line 61 connected to the cathode terminal of PUT 53. Line 48 is connected via a line 62 to the anode terminal of PUT 53. The control or firing terminal of the PUT 53 is connected to line 42.

Line 38 is connected to line 15 via diode 63.

The circuit functions as follows:

The power supply voltage present at the two lines 18 and 19 is rectified by the first rectifier bridge 26, so that at point 27 positive potentials, and at point 28 negative potential, of a pulsating D.C. voltage, is available. Current is therefore supplied via line 38, diode 63, and line 15 to lamp 3 and flows over line 14 to the junction point 28. The capacitor 4 connected in parallel with lamp 3 serves for anitinterference from sparks when using a normal impedance starter. In case of failure in lamp 3, diode 63 prevents a flow of current from capacitor 4 to line 3B.

The two resistors 39 and 44 serve as voltage dividers for a partially stabilized voltage to be taken off at line 40, while at line 45 a stabilized voltage is available through a Zener diode 46. By the voltage divider consisting of the resistors 41 and 43, the partially stabilized voltage of line 40 is adapted to the firing terminal of PUT 53.

When operating the potentiometer 52, switch 37 is closed before wiper **52*a* touches the resistance path of potentiometer 52. As switch 37 closes, the stabilized voltage building up on line 45 in the rhythm of the line frequency charges the capacitor 49 via the resistor 47. The current flow through the relatively high-impedance resistor 47 is so weak that the voltage potential building up in line 61 does not exceed the firing potential applied to the PUT 53 (line 42) until near the end of each half-wave. The through connection of PUT 53 causes, via line 61, a firing of thyristor 29 or 30. However, this firing occurs so late in the course of the respective half-wave that the power supplied to motor 2 via line 33 is not sufficient to cause it to start. But when during further operation of potentiometer 52 the wiper 52*a* thereof moves onto its resistance path, capacitor 49 is additionally supplied with current via line 62 through the components in parallel with resistor 47 (resistors 50 and 51 as well as potentiometer 52), so that the potential line 62 exceeds the reference voltage in line 42 earlier in the phase of the half-wave in accordance with the respective position of potentiometer 52 and hence causes the switching through PUT 53 earlier also. The latter then fires the thrystor 29 or 30 vial line 61. Thus motor 2 is supplied via lines 33 and 16** with the current of the residual half-wave, and starts.

By adjusting the potentiometer 52, the current flow to capacitor 49 is controlled, the connecting-through of PUT 53 and hence also of the thyristor 29 or 30 is achieved earlier or later in the course of the half-wave, and thus the speed of motor 2 is controlled.

Via the voltage divider consisting of the resistors 41 and 43, the reference voltage in line 42 for PUT 53 changes in accordance with the fluctuations of the partially stabilized line voltage, so that the time of switching through of PUT 53 is adapted accordingly and the line voltage altered at motor 2 is compensated.

Upon current flow through motor 2, there occurs in the measuring resistor 35 a voltage drop which is proportional to the current flowing through the measuring resistor 35. The voltage drop occurring in diode 34 equalizes the voltage difference $U_{BE}$ which occurs between line 33 and resistor 58, in transistor 56. Due to the voltage drop at the measuring resistor 35, the base of transistor 56 becomes more positive than the potential of line 36, so that transistor 56 conducts. The emitter resistor 58 then determines the gain of transistor 56. The resistor 57 in parallel with resistor 43 is thus inserted gradually, so that the potential of line 42 decreases and PUT 53 connects through earlier. At increased torque requirement in the lower and medium speed range, therefore, a control occurs due to a greater current supply to motor 2, in that the phase angle control boosts the forward flow angle as compared with its position controlled by the position of wiper 52*a* of potentiometer 52 in accordance with the increased current requirement.

While a specific embodiment of the invention has been shown and described in detail to illustrate the application of the principles of the invention, it will be understood that the invention may be embodied otherwise without departing from such principles.

What is claimed is:

1. A circuit arrangement for a sewing machine having a housing, a motor with a pair of connections and a lamp with a pair of connections, with one connection of the motor and lamp joined together to form a joint connection, comprising:

a pair of power supply lines for receiving electrical power;

a first rectifier bridge comprising a plurality of diodes connected to said power supply lines and having a first terminal connected to said joint connection and a second terminal connected to the other connection of the lamp;

a second rectifier bridge comprising a portion of said first rectifier bridge with one of said first and second terminals, and at least one additional semiconductor device with a third terminal and a control terminal, said second rectifier bridge connected to said power supply lines and said third terminal connected to the other connection of the motor;

phase angle control means for controlling a speed of the motor connected between the other connection of the motor and said control terminal for phase angle controlling said second rectifier bridge;

a plug associated with the sewing machine housing having three plug connections, a first one of said plug connections connected to said joint connection of the motor and lamp, a second one of said plug connections connected to the other connection of the lamp and a third one of said plug connections connected to the other connection of the motor; and a mating plug having three mating plug connections for engaging said first, second and third plug connections, a first one of said mating plug connections connected to said first terminal of said first rectifier diode which forms a negative potential terminal, a second one of said mating plug connections connected by a connecting line to said second terminal of said first rectifier bridge and forming a positive potential terminal, and a third one of said mating plug connections connected to said phase angle control means and said third terminal of said second rectifier bridge forming a positive potential terminal of said second rectifier bridge.

2. A circuit arrangement according to claim 1 including a capacitor connected across the pair of connections of the lamp and in parallel to the lamp, and a diode connected in said connecting line for preventing a flow of current from said capacitor to said second terminal of said first rectifier bridge if the lamp fails while said capacitor is charged.

3. A circuit arrangement according to claim 2, wherein said first rectifier bridge comprises a first pair of diodes extending from said negative potential terminal to fourth and fifth terminals of said second rectifier bridge and a second pair of diodes extending from said fourth and fifth terminals to said positive potential terminal, said fourth and fifth terminals of said second rectifier bridge each connected to one of said power supply lines, said second rectifier bridge comprising said at least one additional semiconductor device and another semiconductor device extending respectively from said fourth and fifth terminals to said positive potential terminal of said second rectifier bridge, each of said at least one additional and other semiconductor devices having a control gate connected to said control terminal of said second rectifier bridge.

4. A circuit arrangement according to claim 3, wherein said at least one additional and other semiconductor devices comprise thyristors, said thyristors and said first mentioned pair of diodes forming said second rectifier bridge.

5. A circuit arrangement according to claim 2, wherein said phase angle control means includes a potentiometer having a pair of terminals, one of said terminals of said potentiometer connected to said second terminal of said first rectifier bridge and the other terminal of said potentiometer connected to an anode of a PUT, said PUT having a cathode connected to said control terminal of said second rectifier bridge.

6. A sewing machine with a housing-connected universal motor as drive motor, a speed control for varying the motor speed, a lamp with a parallel connected capacitor (4), and a plug connection on the sewing machine housing for connecting lines for power supply and speed control with the motor and with the lamp, characterized in that the speed control is a phase angle control which comprises a first rectifier bridge (26) consisting of diodes (22,23,24,25) for current supply to the phase angle control and to the lamp (3) as well as a second rectifier bridge (31) with semiconductor devices (29,30) controlled by the phase angle control, for controlling the motor (2), the plug connection (7,10) between the universal motor and lamp, and the power supply lines (18,19) and speed control, having three terminals, one lead of the motor and one lead of the lamp being jointly connected via one terminal (6,11) of the plug connection to one power supply line, the other lead of the lamp being connected via a second terminal (8,12) of the plug connection to the other power supply line and to one line of the speed control, and another lead of the motor being connected via a third terminal (9,13) of the plug connection to a second line of the speed control, the power supply lines (18,19) being connected at both rectifier bridges (26,31), a negative terminal (28) of which is connected to a joint terminal (6,11) of motor (2) and lamp (3), while a positive terminal (32) of the second rectifier bridge (31), which is controlled by phase angle is connected to the second terminal (9,13) of the motor (2) and a positive terminal (27) of the first rectifier bridge (26) is connected to the second terminal (8,12) of the lamp (3), with a diode (63) arranged in the connection (15) between the positive terminal (27) of the first rectifier bridge (26) and the second terminal (8,12) of the lamp (3).

7. A sewing machine according to claim 6, wherein the phase angle controlled rectifier bridge (31) consists of two thyristors (29,30), connected by their positive terminal (32), and of the diodes (22,23) connected to the negative terminal (28) of the diode rectifier bridge (26).

8. A sewing machine according to claim 6, wherein the motor has a circuit with a measuring resistor (35) provided which serves as a control element for torque boost.

* * * * *